US005499553A

United States Patent [19]

Schott et al.

[11] Patent Number: 5,499,553

[45] Date of Patent: Mar. 19, 1996

[54] CONTROL LEVER LOCKOUT MECHANISM

[75] Inventors: Allan N. Schott, Warren; Mario P. Girard, Winnipeg, both of Canada

[73] Assignee: New Holland North America, Inc., New Holland, Pa.

[21] Appl. No.: 154,058

[22] Filed: Nov. 18, 1993

[51] Int. Cl.[6] ..... G05G 5/06

[52] U.S. Cl. ..... 74/526; 74/532

[58] Field of Search ..... 74/526, 527, 529, 74/532, 475; 180/332, 333, 334

[56] References Cited

U.S. PATENT DOCUMENTS 4,548,094 10/1985 Huitema ..... 74/526

5,062,316 11/1991 Lykken et al. ..... 74/527 X

*Primary Examiner*—Charles A. Marmor

*Assistant Examiner*—Mary Ann Battista

*Attorney, Agent, or Firm*—Larry W. Miller; Frank A. Seemar

[57] ABSTRACT

A mechanism controls the pivotal positioning of a hydraulic control lever on tractors wherein a gated plate is affixed to the control lever to be pivotally moveable therewith into selective engagement with a lockout pin projecting outwardly from a pivoted actuating lever. The gated plate has first and second gates for selectively receiving the lockout pin when in a first position to restrict the pivotal movement of said control lever in preselected manners. The gated plate further includes a stop engageable with the lockout pin when in a second position to prevent the control lever from being placed in a float position. A third selectable position of said actuating lever places the lockout pin out of engagement with said gated plate to allow an unrestricted freedom of movement of the control lever. The pivoted control lever and the pivoted actuating lever project outwardly through a control panel for manipulation thereof.

13 Claims, 3 Drawing Sheets

CONTROL LEVER LOCKOUT MECHANISM

BACKGROUND OF THE INVENTION

This invention relates generally to control levers used on machinery such as agricultural tractors to operate hydraulic devices and, more particularly, to a mechanism cooperable with the control lever to limit the movement thereof and, thereby, restrict the operation of the corresponding hydraulic device.

One rotatable control lever position control apparatus is disclosed in U.S. Pat. No. 4,548,094, issued to Thomas W. Hultema, et al, on Oct. 22, 1985. This apparatus is in the form of a cylinder having notches formed therein to engage the control lever passing therethrough and limit the movement of the control lever in accordance with the notch aligned with the control lever. The cylinder is provided with a thumb wheel member that projects upwardly through the control panel for rotation by the operator to select the respective notch to be aligned with the control lever.

It is desirable to provide an alternative control lever position control mechanism having a more positively engageable pivotal actuation lever for manipulation by the operator to select the various modes of operation of the hydraulic system. Furthermore, it would be desirable to provide an alternative position control mechanism that would be operable to select a greater range of hydraulic system modes of operation.

SUMMARY OF THE INVENTION

It is an object of this invention to provide a hydraulic control lever position control mechanism that is pivotally movable between selected positions.

It is another object of this invention to provide a position control mechanism that enables a greater variety of operative modes for the operation of the associated hydraulic system.

It is a feature of this invention to provide a hydraulic lever position control mechanism that provides the functions of a neutral lock, a float lockout, a lock into a hydraulic motor mode, and an unrestricted free range of movement of the control lever.

It is an advantage of this invention that the position control mechanism provides four separate functions of operation of the corresponding hydraulic system through a pivotal actuating lever movable between three positions.

It is another advantage of this invention that the operator can positively orient the position control mechanism in a selected orientation for selection of the desired function of the associated hydraulic system.

It is another feature of this invention that the operator has a readily visible feedback from the selected pivoted orientation of the actuating lever to determine the function of the associated hydraulic system that has been selected.

It is still another object of this invention to provide a single lever operated mechanism to control all of the desired features and functions of a tractor hydraulic system.

It is further object of this invention to provide a position control mechanism cooperable with a tractor hydraulic control lever which is durable in construction, inexpensive of manufacture, carefree of maintenance, facile in assemblage, and simple and effective in use.

These and other objects, features, and advantages are accomplished according to the instant invention by providing a mechanism for controlling the pivotal positioning of a hydraulic control lever on tractors wherein a gated plate is affixed to the control lever to be pivotally moveable therewith into selective engagement with a lockout pin projecting outwardly from a pivoted actuating lever. The gated plate has first and second gates for selectively receiving the lockout pin when in a first position to restrict the pivotal movement of said control lever in preselected manners. The gated plate further includes a stop engageable with the lockout pin when in a second position to prevent the control lever from being placed in a float position. A third selectable position of said actuating lever places the lockout pin out of engagement with said gated plate to allow an unrestricted freedom of movement of the control lever. The pivoted control lever and the pivoted actuating lever project outwardly through a control panel for manipulation thereof.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
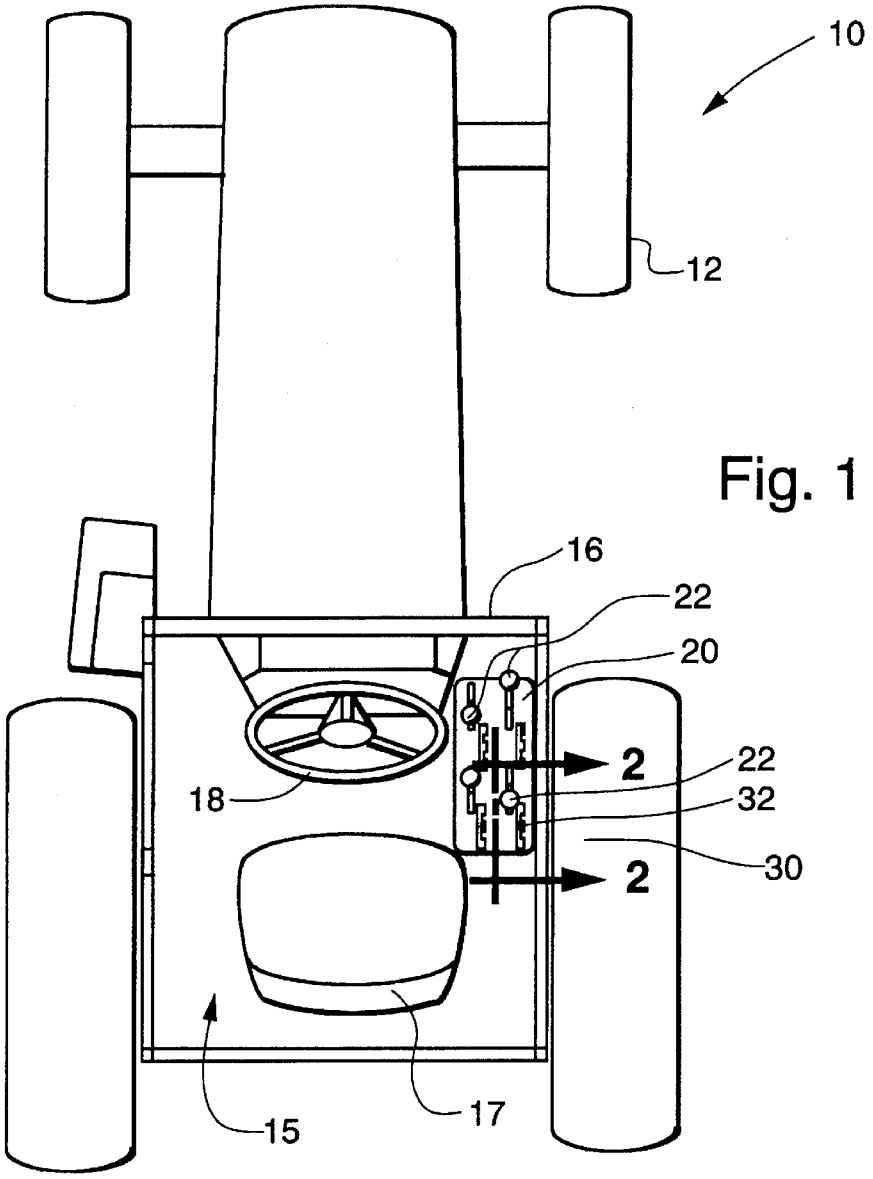
FIG. 1 is a schematic top plan view of a tractor incorporating the principles of the instant invention, the tractor being provided with an operator's station including a multi-lever control panel for operating various tractor hydraulic devices.

Referring now to FIG. 1, a representative schematic tractor can best be seen. The tractor 10 includes a wheeled platform 12 supporting an operator's station 15 in a conventional manner. The operator's station 15 may include an enclosed operator cab 16 in which is positioned a seat 17, conventional steering mechanism 18 and a control panel 20 within arm's reach of the seat 17. The control panel 20 is typically provided with several control levers 22 projecting upwardly through the control panel 20 for manipulation thereof by the operator to control various conventional hydraulic devices (not shown) known to be incorporated into modern tractors 10.

Referring now to FIGS. 2–6, the details of the position control mechanism 30 can best be seen. The representative control lever 22 is pivotally supported by a first pivot 23 carried by the subframe 21 of the control panel 20 for movement in a fore-and-aft direction. The control panel 20 is provided with a first slotted opening 24 therein to accommodate this pivotal movement of the control lever 22. The control lever 22 is equipped with a gated plate 25 that is pivotal with the lever 22 about the supporting first pivot 23. The gated plate 25 is formed with a first gate 26, an elongated second gate 27, and a stop member 28 oriented adjacent the second gate 27.

Figure 6:
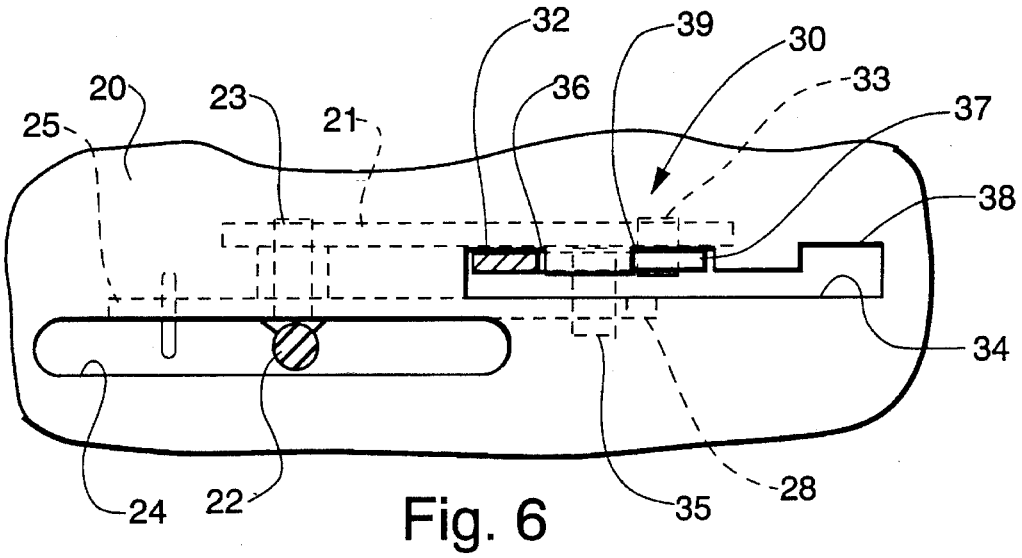
FIG. 6 is a partial cross-sectional view of the control lever taken along lines 6—6 of FIG. 2 to depict an enlarged top plan view of the slotted openings in the control panel provided for movement of the control lever and the corresponding actuating lever.

The position control mechanism 30 includes an actuating lever 32 which is pivotally supported from the subframe 21 of the control panel 20 by a second pivot 33 to permit movement of the actuating lever 32 in a fore-and-aft direction generally parallel to the movement of the control lever 22. The actuating lever 32 is provided with a lockout pin 35 projecting transversely to the plane of the actuating lever 32 to be engageable with the gated plate 25. The actuating lever, as best seen in FIG. 6, is movable within a second slotted opening 34 in the control panel 20 between three selectable positions. The second slotted opening 34 is provided with three detention notches 36, 37, 38 for retaining the actuating lever 32 in its preselected position. The actuating lever 32 is associated with a spring device 39 to urge the lever 32 into engagement with the notches 36, 37, 38. To move the actuating lever 32 from one notch to the other, the biasing force exerted by the spring 39 can be manually overcome to move the lever 32 within the second slotted opening 34.

As best seen in FIGS. 2–5, the control lever 22 is movable between four operating positions. The rearwardmost position, shown in solid lines in FIG. 3 and in phantom in FIG. 4, corresponds to a "raise function" in which the hydraulic fluid within the hydraulic system associated with the control lever 22 is permitted to flow in a first direction, typically to effect a raising of an implement attached to the tractor. The primary intermediate position of the lever 22 is shown in solid lines in FIG. 2 and corresponds to a neutral position in which the hydraulic fluid within the associated hydraulic system is prevented from flowing through the system and doing any work.

Figure 3:
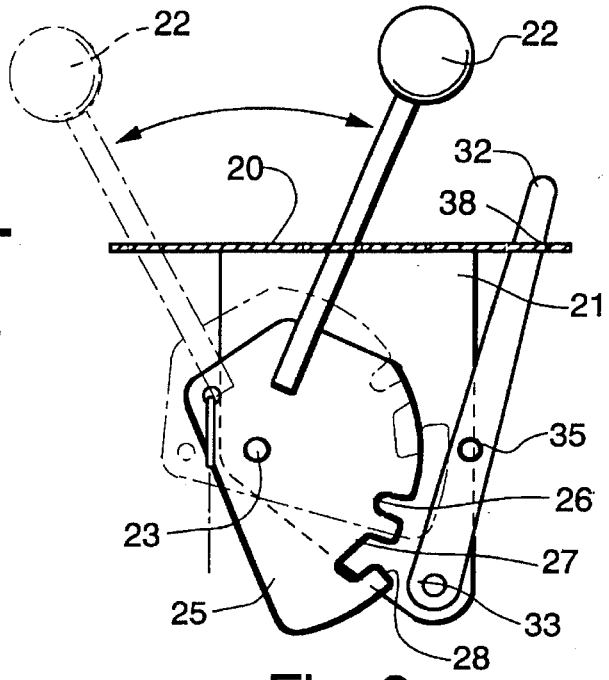
FIG. 3 is a partial cross-sectional view corresponding to the view of FIG. 2, except that the actuating lever has been retracted into a disengagement position to allow the unrestricted free pivotal movement of the control lever.
Figure 4:
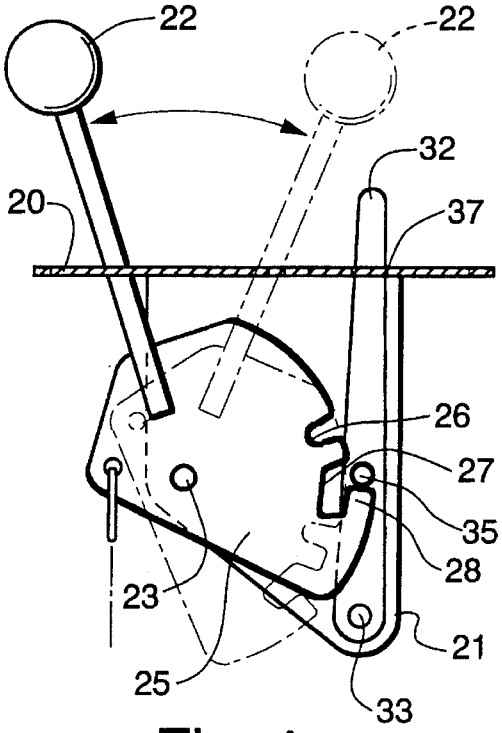
FIG. 4 is another partial cross-sectional view corresponding to the view of FIG. 2 with the actuating lever being positioned to prevent the control lever from being placed into a float mode.
Figure 5:
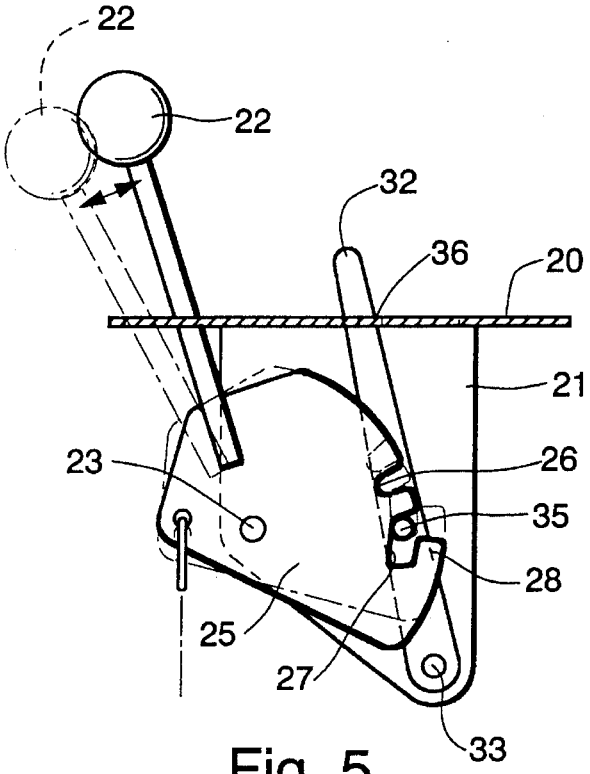
FIG. 5 is still another partial cross-sectional view of the control lever corresponding to the view of FIG. 2 with the actuating lever being place into an orientation restricting the movement of the control lever between the lower position and the float position, also known as a hydraulic motor mode.

The primary forward position of the lever 22 is shown in solid lines in FIGS. 4 and 5 and corresponds to a "lower function" in which the hydraulic fluid within the hydraulic system associated with the control lever 22 is permitted to flow in a second direction opposite to the "raise function" typically to effect a lowering of an implement attached to the tractor. The forwardmost operating position is shown in phantom in FIGS. 3 and 5 and corresponds to a "float function" in which the hydraulic fluid is permitted to flow through the hydraulic system in either the first or second directions. The "float function" is associated with a conventional detent mechanism in the hydraulic system to lock the system in this operation until the lever 22 is physically moved from this position.

Figure 2:
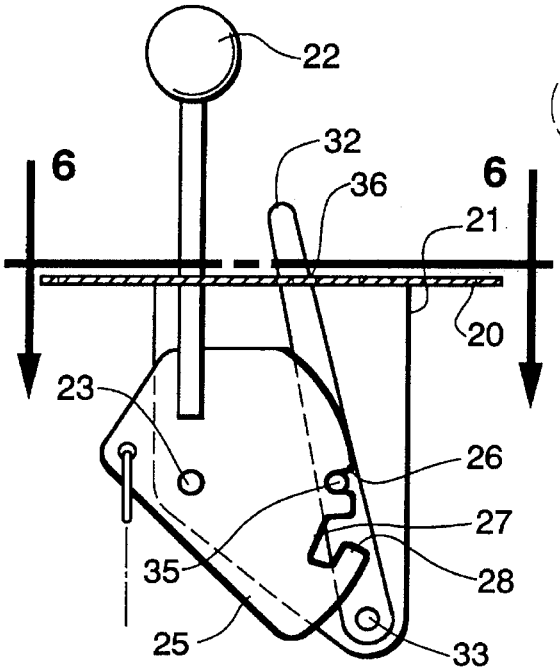
FIG. 2 is a partial cross-sectional view of a representative control lever corresponding to lines 2—2 of FIG. 1 with the control lever being locked into a neutral mode by the pivoted actuating lever of the corresponding lockout assembly.

As best seen in the comparison of the views of FIGS. 2–5, the gated plate 25 rotates about the first pivot 23 whenever the control lever 22 is moved between its respective positions. The adjacent actuating lever 32 is selectively positionable to locate the lockout pin 35 in engagement with the gated plate 25. As depicted in FIG. 2, the actuating lever 32 is moved to the forwardmost notch 36 to locate the lockout pin 35 in the first gate 26. The lockout pin 35 can only be received in the first gate 26 when the control lever 22 is placed in the intermediate neutral position. Once the actuating lever 32 is restrained within the forwardmost notch 36 by the spring device 39 and the lockout pin 35 received in the first gate 26, the hydraulic system is locked in the neutral function until the actuating lever 32 is disengaged from the gated plate 25. Accordingly, the configuration of the position control mechanism 30 shown in FIG. 2 provides a neutral lock for the hydraulic system associated with the control lever 22.

Referring now to FIG. 5, one skilled in the art can see that the placement of the actuating lever 32 in the forwardmost notch 36 when the control lever 22 is in the primary forwardmost (lower) position allows the lockout pin 35 to be received in the elongated second gate 27. In this orientation, the position control mechanism 30 locks the hydraulic system in a "hydraulic motor mode" in which the control lever 22 is permitted to move between the lower position and the float position. This hydraulic motor mode allows the hydraulic system to work a hydraulic motor, which generally operates in a single direction or is placed in an non-operating condition. The placement of the control lever 22 in the lower position directs the hydraulic fluid in a fixed direction to operate the hydraulic motor, i.e. placing the hydraulic motor in an "on" condition. Pushing the control lever 22 to the float position effectively turns the hydraulic motor "off" or places it in a neutral condition since the hydraulic fluid is not forced through the system in any direction.

Referring to the configuration of the gated plate 25 as shown in FIGS. 2–5, it can be seen that the actuating lever 32 cannot be placed into the forwardmost notch 36 unless the control lever 22 is in the neutral or lower positions because of the interference between the lockout pin 35 and the gated plate 25. Accordingly, the forwardmost notch 36 is used by the operator only when the neutral lock feature or the hydraulic motor mode feature is desired.

Placement of the actuating lever 32 in the intermediate notch 37 locates the lockout pin 35 in an interfering position with respect to the stop member 28 forming a part of the gated plate 25. This interference between the stop member 28 and the lockout pin 35 restricts the pivotal movement permitted the gated plate 25 and prevents the control handle from reaching the forwardmost float position. Accordingly, the placement of the actuating lever 32 in the intermediate notch 37 provides a float lockout, while allowing a full range of movement of the control lever 22 between the raise, lower and neutral positions. As noted above, the actuating lever 32 cannot be placed into the intermediate notch 37 if the control lever 22 is already positioned in the float position because of the interference between the lockout pin 35 and the structure of the gated plate 25.

As depicted in FIG. 3, the placement of the actuating lever 32 in the rearwardmost notch 38 retracts the lockout pin 35 from any engagement with the gated plate 25 and, therefore, allows an unrestricted free movement of the control lever 22 between all four selectable positions, including the float position shown in phantom in FIG. 3.

The position control mechanism 30 provides a positively engageable pivotal lever 32 that is restrained in a preselected position in a positive manner. The operator can determine which lockout mode he has selected, if any, merely by observing the relative positions of the control lever 22 and/or the actuating lever 32.

Figure 7:
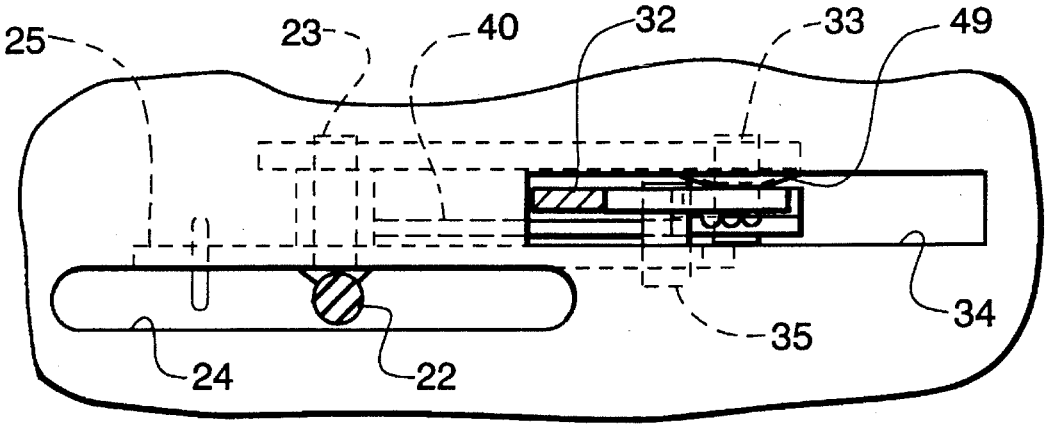
FIG. 7 is a partial cross-sectional view similar to the view of FIG. 6 of an alternative embodiment of the actuating lever assembly.
Figure 8:
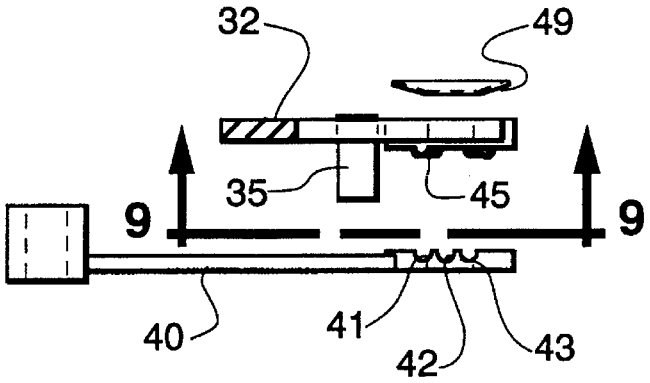
FIG. 8 is an exploded detail view of the dogbone washer and actuating lever forming part of the alternative embodiment shown in FIG. 7 to depict the relationship therebetween.
Figure 9:
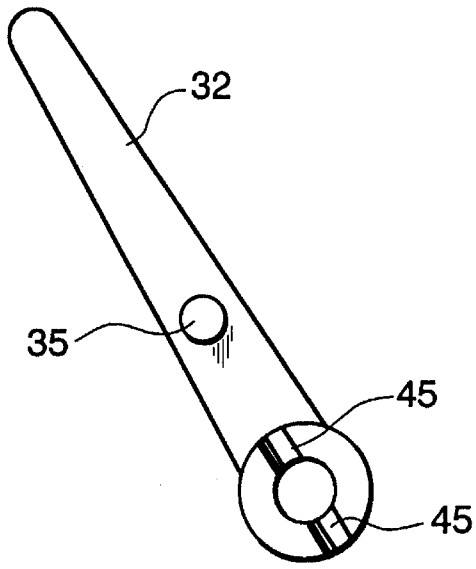
FIG. 9 is a detail view of the actuating lever to depict the detent engageable with the notches in the dogbone washer to restrict movement of the actuating lever.

Referring now to FIGS. 7–9, an alternative embodiment of the actuating lever 32 can be seen. Whereas the embodiment depicted in FIGS. 1–6 used notches 36, 37 and 38 into which the actuating lever 32 was spring-loaded, the alternative embodiment of FIGS. 7–9 provides a smooth slotted opening 34 through which the actuating lever 32 extends and moves the detent mechanism below the top portion of the control panel 20 to provide a cleaner design. The basic operation of the interrelationship of the actuating lever 32 and the control lever 22 remains unchanged from that described above.

To restrict the motion of the actuating lever 32, a dogbone washer 40 is provided to interconnect the first and second pivots 23, 33. The end of the dogbone washer 40 encircling the second pivot 33 is provided with three notches 41, 42 and 43, which correspond to the notches 36, 37 and 38 in the embodiment of FIGS. 1–6. A detent 45 forming a part of the actuating lever 32 is engageable with the notches 41, 42 and 43 to restrict rotational movement of the actuating lever 32 about the second pivot 33. A conventional spring washer assembly 49 urges the detent 45 into the notches 41, 42 and 43. The dogbone washer extends to encircle the first pivot 23 as a means of preventing the dogbone washer 40 from rotating about the second pivot 33.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. In a tractor having a mobile frame movable over the ground; an operator's station supported on said frame; a hydraulic system including at least one pivotally mounted control lever movable to a first position in which movement of hydraulic fluid is effected only in a first direction through said system, a second position in which movement of said hydraulic fluid is effected only in a second direction through said system, a neutral position in which said hydraulic fluid is prevented from movement, and a float position in which said hydraulic fluid is free to move in either said first or said second direction; and power means supported on said frame to provide operative power for the movement of said mobile frame and operation of said hydraulic system, the improvement comprising:

a pivotable lockout means associated with said control lever and operable to restrict movement of said control lever between the respective said positions in the following manner:

a float lockout mode in which said control lever is prevented from reaching said float position, but is unrestricted in selective movement between said first, second and neutral positions;

a neutral lock mode in which said control lever is locked in the neutral position and is prevented from being moved to any other respective position;

a hydraulic motor mode in which said control lever is freely movable between said first position and said float position, but is prevented from being moved to said neutral or second positions; and a disengagement mode in which said control lever is free for selective movement in any of said first, second, float or neutral positions; and said lockout means including a gated plate forming part of said control lever to be pivotally movable therewith and a lockout assembly engageable with said gated plate, said lockout assembly including a pivoted actuating lever having a lockout pin engageable with said gated plate, said gated plate including a first gate engageable with said lockout pin to correspond to said neutral lock mode;

a second elongated gate engageable with said lockout pin to correspond to said hydraulic motor mode; and a stop engageable with said lockout pin to correspond to said float lockout mode.

2. The tractor of claim 1 wherein said actuating lever is positionable such that said gated plate will not engage said lockout pin to correspond to said disengagement mode.

3. The tractor of claim 2 wherein said actuating lever is movable between three positions to locate said lockout pin for engagement with one of said gates, for engagement with said stop, and for disengagement from said gated plate.

4. The tractor of claim 3 wherein said hydraulic system includes a plurality of said control levers and a plurality of corresponding said actuating levers, said operator's station including a control panel having a first slotted opening for each said control lever and an adjacent second slotted opening for each said corresponding said actuating lever, each said control lever and each said actuating lever projecting outwardly through said control panel for pivotal manipulation thereof.

5. The tractor of claim 4 wherein each said second slotted opening is formed with three detention notches corresponding to the three said positions of the,respective said actuating lever, each said detention notch being operable to retain the corresponding said actuation lever in the selected position.

6. The tractor of claim 5 wherein each said actuating lever is spring-loaded toward engagement with said detention notches.

7. The tractor of claim 4 wherein each said actuating lever is provided with a detent member cooperable with a retention assembly having three notches formed therein, said retention assembly and said actuating lever being urged into engagement so that said detent member is restrained within one of said notches corresponding to the selected position of said actuating lever.

8. A position control mechanism for a pivotally movable control lever comprising:

a pivoted actuating lever having a lockout pin projecting outwardly therefrom, said actuating lever being movable between three respective pivoted positions; and a gated plate pivotally movable with said control lever, said gated plate including:

a first gate engageable with said lockout pin when said actuating lever is in a first position to fix said control lever in a neutral mode;

a second elongated gate alternatively engageable with said lockout pin when said actuating lever is in said first position to fix said control lever in a hydraulic motor mode; and a stop engageable with said lockout pin when said actuating lever is in a second position to restrain the pivotal movement of said control lever from being positioned in a float mode; and said lockout pin being positionable out of engagement with said gated plate when said actuating lever is in a third position to allow said control lever an unrestricted freedom of movement.

9. The position control mechanism of claim 8 wherein said control lever is operatively connected to a hydraulic system for selectively placing said hydraulic system in a first mode in which movement of hydraulic fluid through said hydraulic system is effected only in a first direction, in a second mode in which movement of said hydraulic fluid through said hydraulic system is effected only in a second direction, in said neutral mode in which said hydraulic fluid is prevented from movement within said hydraulic system, and in said float mode in which said hydraulic fluid is free to move through said hydraulic system in either said first or said second direction, said control lever being positionable in said hydraulic motor mode in which said control lever is selectively positional between said first mode and said float mode.

10. The position control mechanism of claim 9 wherein said control lever and said actuating lever project outwardly for pivotal manipulation thereof through a control panel having a first slotted opening to permit movement of said control lever and an adjacent second slotted opening for accommodating the movement of said actuating lever.

11. The position control mechanism of claim 10 wherein said actuating lever is provided with a detent member cooperable with a retention assembly having three notches formed therein, said retention assembly and said actuating lever being urged into engagement so that said detent member is restrained within one of said notches corresponding to the selected position of said actuating lever.

12. The position control mechanism of claim 11 wherein said actuating lever is spring-loaded toward engagement with said detention notches.

13. The position control mechanism of claim 10 wherein said second slotted opening is formed with three detention notches corresponding to the three positions of said actuating lever, each said detention notch being operable to retain said actuation lever in the selected position.

* * * * *